US005964120A

United States Patent [19]

Iwase et al.

[11] Patent Number: 5,964,120

[45] Date of Patent: Oct. 12, 1999

[54] HOT EXTRUSION FORGING DIE FOR USE IN TITANIUM ALLOY

[75] Inventors: Satoru Iwase; Mikiharu Yoshizaka; Shigeki Yamada; Hiroyuki Fujimoto, all of Obu, Japan

[73] Assignee: Aisan Kogyo Kabushiki Kaisha, Obu, Japan

[21] Appl. No.: 08/931,674

[22] Filed: Sep. 16, 1997

[30] Foreign Application Priority Data

Oct. 28, 1996 [JP] Japan ..... 8-285468

[51] Int. Cl.[6] ..... B21C 25/02

[52] U.S. Cl. ..... 72/467; 72/272

[58] Field of Search ..... 72/467, 253.1, 72/42, 272

[56] References Cited

U.S. PATENT DOCUMENTS

| | | | |
|---|---|---|---|
| 2,882,759 | 4/1959 | Altwicker | 72/467 |
| 2,907,454 | 10/1959 | Sejournet | 72/467 |
| 3,469,436 | 9/1969 | Gyorgak | 72/467 |
| 3,628,370 | 12/1971 | Phillips | 72/467 |
| 3,680,354 | 8/1972 | Phillips | 72/467 |
| 3,691,811 | 9/1972 | Heitman | 72/272 |
| 3,893,326 | 7/1975 | Oberlander | 72/467 |
| 4,038,858 | 8/1977 | DeZuba | 72/467 |
| 4,468,947 | 9/1984 | Takeda | 72/467 |
| 4,773,251 | 9/1988 | Kohnhauser | 72/467 |

FOREIGN PATENT DOCUMENTS

| | | | |
|---|---|---|---|
| 8180 | 3/1968 | Japan | 72/467 |
| 149011 | 6/1988 | Japan | 72/467 |

*Primary Examiner*—Daniel C. Crane
*Attorney, Agent, or Firm*—Nikaido, Marmelstein, Murray & Oram LLP

[57] ABSTRACT

When used, a hot extrusion forging die for use in titanium alloy according to the present invention extrusion works a heated titanium alloy-made billet in such a manner as to diameter-reduce the billet. The hot extrusion forging die for use in titanium alloy according to the present invention is equipped with a die member for extrusion working. The die member is made of ceramic. The forging die according to the present invention makes it possible to suppress the sticking of the die member onto an extruded work to thereby make it easy to take out the extruded work. Also, the forging die according to the present invention makes it possible to suppress the seizure of the titanium alloy-made billet, with the result that there can be used a lubricant for which the removing operation is not needed to be done.

9 Claims, 2 Drawing Sheets

HOT EXTRUSION FORGING DIE FOR USE IN TITANIUM ALLOY

BACKGROUND OF THE INVENTION

Field of the Invention

The present invention relates to a hot extrusion forging die for use in titanium alloy. When used, the hot extrusion forging die for use in titanium alloy extrusion works a heated titanium alloy-made billet in such a manner as to diameter-reduce the billet.

Description of the Related Art

A hot extrusion forging die is equipped with a die member and a punch. The die member is for the purpose of extrusion working a billet in such a manner as to diameter-reduce the billet. And, the die member is ordinarily made of alloy tool steel.

However, this type of hot extrusion forging die had the following problem when extrusion working a titanium alloy-made billet. This problem is that the taking-out of an extruded work by a knockout device becomes impossible. The time when such an inconvenience occurs is the time when the temperature of the die member and the extruded work has been excessively lowered. This excessive drop in temperature of the die member and the extruded work occurs when the taking-out of the extruded work by the knockout device has been late. The failure of taking out the extruded work occurs for the following reason. That is, the coefficient of linear expansion of alloy tool steel is larger than that of titanium alloy. Therefore, if the temperature of the die member and the extruded work is lowered, the die member sticks to the extruded work. As a result, taking-out of the extruded work by the knockout device becomes impossible. In this connection, the coefficient of linear expansion of titanium alloy is $8.4\times10^{-6}/°$ C. The coefficient of linear expansion of alloy tool steel (e.g., SKD 61) is $10.5\times10^{-6}/°$ C.

Also, the dependency upon temperature of the deformability of titanium material is very high. For this reason, when at the time of extrusion working the surface of the material is cooled by the die member, a crack occurs (at the position of a shaft portion Wb in FIG. 1 there occurs a crack such as that wherein the upper side and the lower side separate from each other). In order to prevent the occurrence of this crack, it is necessary that the titanium alloy-made billet be heated at 900° C. or higher. Also, in order to prevent the occurrence of the crack, it is also necessary that the die member be preheated at a high temperature of 200 to 550° C. or so.

However, when the die member is made of alloy tool steel, the die member adheres to the billet due to the temperature at which the die member is preheated. That is, the titanium alloy-made billet seizes to the die member. In order to prevent this seizure, it is necessary that a lubricant of a glass system be coated onto the billet beforehand.

However, if the lubricant of a glass system is coated onto the billet, after extrusion working this lubricant must be removed. For this reason, the postworking processing necessitates time and labour very much.

SUMMARY OF THE INVENTION

An object of the present invention is to solve the above-mentioned problems. That is, another object of the present invention is to provide a hot extrusion forging die for use in titanium alloy which makes it easy to take out the extruded work. That is, this another object of the present invention is to provide a hot extrusion forging die for use in titanium alloy which can suppress the sticking of the die member onto the extruded work. Still another object of the present invention is to provide a hot extrusion forging die for use in titanium alloy which can use a lubricant, the removal of which is unnecessary. That is, this third object of the present invention is to provide a hot extrusion forging die for use in titanium alloy which can suppress the seizure of the titanium alloy-made billet onto the die member.

The above objects of the present invention can be attained by a hot extrusion forging die for use in titanium alloy which comprises a die member for extrusion working a titanium alloy-made billet in such a manner as to reduce the diameter of this billet, and the die member being made of ceramic.

And, preferably, around the die member there is caused to be disposed an inside reinforcement ring made of steel material having a toughness such that this ring has an interference with respect to the die member, and, further, around the inside reinforcement ring there is caused to be disposed an outside reinforcement ring made of steel material having a toughness such that this ring has an interference with respect to the inside reinforcement ring, and, the interference between the die member and the inside reinforcement ring is formed as an interference for shrinkage fitting.

Furthermore, preferably, the outer-peripheral surface of the die member is made straight and the inner-peripheral surface of the inside reinforcement ring is made straight in correspondence with the outer-peripheral surface of the die member.

In the hot extrusion forging die for use in titanium alloy according to the present invention, the die member for restricting the titanium alloy-made billet is made of ceramic.

The coefficient of linear expansion of ceramic (e.g., $Si_3N_4$) is $3.0\times10^{-6}/°$ C., which is smaller than the coefficient of linear expansion ($8.4\times10^{-6}/°$ C.,) of titanium alloy. For this reason, even when the taking-out of the extruded work by a knockout device immediately after the performance of the extrusion working is late with the result that the temperature of the die member has been lowered, the die member does not stick to the extruded work. As a result, the taking-out of the extruded work becomes easy.

Also, when the die member is made of ceramic, the die member is unlikely to adhere to the billet even if preheated at 200° C. or more. Therefore, the seizure of the titanium alloy-made billet to the die member becomes unlikely to occur. This makes it possible to use a graphite coating as a lubricant for use in the billet. The graphite coating or the like is not needed to be removed after working. Accordingly, a manufacturer of the work can smoothly perform the extrusion working by using the lubricant not needed to be removed such as the graphite coating without spending time and labour very much.

Accordingly, when used, the hot extrusion forging die for use in titanium alloy according to the present invention makes it possible to suppress the sticking of the die member onto the extruded work to thereby make it easy to take out the extruded work. Also, when used, the hot extrusion forging die for use in titanium alloy according to the present invention makes it possible to suppress the seizure of the titanium alloy-made billet, with the result that there can be used the lubricant for which the removing operation is not needed to be done.

And, if the forging die is constructed as follows, further merits can be brought about. That is, around the die member, there is disposed the inside reinforcement ring made of steel material having a toughness such that this ring has an interference with respect to the die member. Further, around the inside reinforcement ring, there is disposed the outside reinforcement ring made of steel material having a toughness such that this ring has an interference with respect to the inside reinforcement ring. And, the interference between the die member and the inside reinforcement ring is formed as an interference for shrinkage fitting. If the arrangement is made like this, it is possible to ensure a large interference at even the time of preheating with respect to the die member without damaging this die member. Also, it is possible to ensure a high strength of the extrusion working die member.

The reason for this is as follows. In a case where only one reinforcement ring is provided around the ceramic-made die member, there arises the necessity of preheating also this one reinforcement ring at 200° C. or more. However, in the case of only the reinforcement ring alone made of steel material having a toughness, for example, alloy tool steel, when this ring is preheated at a temperature of 550° C. or so, the interference becomes inconveniently small at the preheating time. This is because the coefficient of linear expansion of ceramic is small (the coefficient of linear expansion of, for example, $Si_3N_4$ is $3.0\times10^{-6}$/° C.) and the coefficient of linear expansion of steel is large (the coefficient of linear expansion of, for example, SKD 61 is $10.5\times10^{-6}$/° C.). For this reason, in the case where only one reinforcement alone is provided around the ceramic-made die member, a large interference becomes necessary. However, shrinkage fitting is a mode of fitting in which the ring is assembled by being shrunk after having been thermally expanded. That is, the application of shrinkage fitting cannot ensure a large interference. Therefore, it results that in order that a large interference can be ensured, assembling is performed by force-insertion (taper force-insertion) utilizing a taper surface. However, when ensuring a large interference by such a taper force-insertion, microcracks occur in the outer-peripheral surface of the ceramic-made die member. And, during the use thereof, the cracks are grown with the result that the die member is inconveniently broken early.

For example, in a case where the material quality of the reinforcement ring is alloy tool steel, in order to ensure the strength at the time of quenching the shrinkage fitting is performed at 600° C. or so lower than the tempering temperature. Therefore, when preheating is performed at a temperature of 550° C., the temperature difference between the tempering temperature and the preheating temperature is only 50° C. As a result, with the shrinkage fitting of alloy tool steel, it is impossible to ensure a large interference.

In contrast to this, if the inside reinforcement ring is assembled around the die member by shrinkage fitting and further around this inside reinforcement ring there is assembled the outside reinforcement ring made of alloy tool steel such that this ring has an interference, the following merits are produced. That is, the inside reinforcement ring is not only caused to act on the die member but the interference of the outside reinforcement ring can also be caused to act thereon through the inside reinforcement ring. Therefore, a large interference can be ensured with respect to the die member at the preheating time. And, since the inside reinforcement ring is assembled to the die member by shrinkage fitting, the inside reinforcement ring has a small interference, with the result that there is no likelihood of the die member being broken. Conversely, the inside reinforcement ring can serve as a cushion for a pressing force applied by the interference of the outside reinforcement ring to the die member and can buffer this pressing force. For this reason, the inside reinforcement ring can contribute to preventing the die member from being broken due to the interference of the outside reinforcement ring. That is, even when the outside reinforcement ring is assembled to the inside reinforcement ring by the taper force-insertion enabling its ensurement of a large interference with respect to the inside reinforcement ring, the die member is not broken. And, the outside reinforcement ring can ensure a large interference of the inside reinforcement ring with respect to the die member.

And, further, in a case where the inside reinforcement ring is assembled to the die member, if the outer-peripheral surface of the die member and the inner-peripheral surface of the inside reinforcement ring are respectively correspondingly made straight and the both are assembled together by shrinkage fitting without utilizing a taper surface, the following mertis are produced. That is, it is possible to suppress the occurrence of variation in the interference due to the error made in taper angle or reference diameter position, with the result that a stable interference can be ensured. As a result, the durability of the die member can be enhanced.

DETAILED DESCRIPTION OF THE PREFERRED EMBODIMENTS

An embodiment of the present invention will now be explained with reference to the drawings. It is to be noted that the invention is not limited to the embodiments which will be described hereafter. All changes or modifications made within, or all equivalents to, the subject matter claimed in the claims are included within the scope of these claims.

Figure 1:
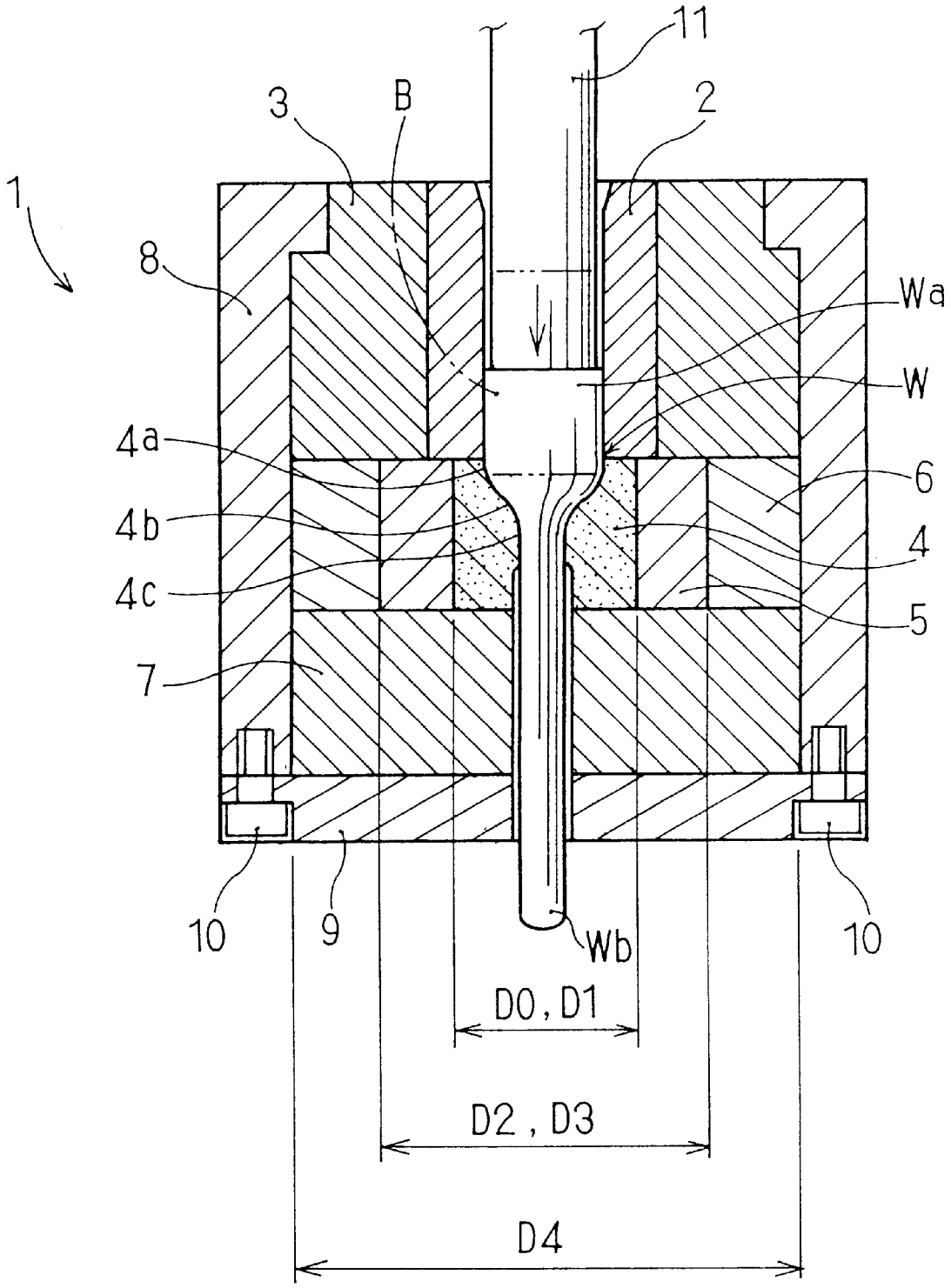
FIG. 1 is a sectional view illustrating a hot extrusion forging die for use in titanium alloy according to an embodiment of the present invention.

As illustrated in FIG. 1, a hot extrusion forging die 1 for use in titanium alloy according to this embodiment is equipped with a substantially circular-cylindrical diamter-reducing die member 4 in order to work a titanium alloy-made circular-columnar billet B into an extruded work W. The die member 4 has a large-diameter hole portion 4*a* and a small-diameter hole portion 4*c*. A throat portion 4*b* shaped like a taper is disposed between the large-diameter hole portion 4*a* and the small-diameter hole portion 4*c*.

It is to be noted that the extruded work W is an unfinished product which is used as a titanium alloy-made engine valve blank. Therefore, after extrusion working, a large-diameter portion Wa of the extruded work W which is located above a shaft portion Wb thereof is swaged.

In the forging die 1, a circular-cylindrical guiding die member 2 is disposed on the upside of the diameter-reducing die member 4. The guiding die 2 is for the purpose of guiding the billet B into the die member 4. A substantially circular-cylindrical reinforcement ring 3 is assembled in such a way as to surround the die member 2.

Around the diameter-reducing die member 4, there is assembled a circular-cylindrical inside reinforcement ring 5, around which there is assembled a circular-cylindrical outside reinforcement ring 6. Further, on the underside of the die member 4 and reinforcement rings 5, 6, there is disposed a pressure receiving plate 7, on the underside of which there is disposed a cap 9. The cap 9 is fastened to a circular-cylindrical case 8 by means of bolts 10. The case 8 covers the outer-peripheral surfaces of the reinforcement rings 3, 6 and pressure receiving plate 7. By the cap 9 being fastened to the case 8, the die members 2 and 4, rings 3, 5 and 6 and the like are integrated together, and, in this condition, these are disposed on a bolster not illustrated of a presser.

The diameter-reducing die member 4 is made of silicon nitride. The guiding die member 2 and the reinforcement rings 3, 5 and 6 are each made of SKD 61 which is one of the alloy tool steels for use in hot working. For example, the die member 4 may be made of another ceramic material such as SIALON. Also, the die member 2 and the reinforcement rings 3, 5 and 6 may each be made of another alloy tool steel for use in hot working or the like such as SKD 6.

Figure 2:
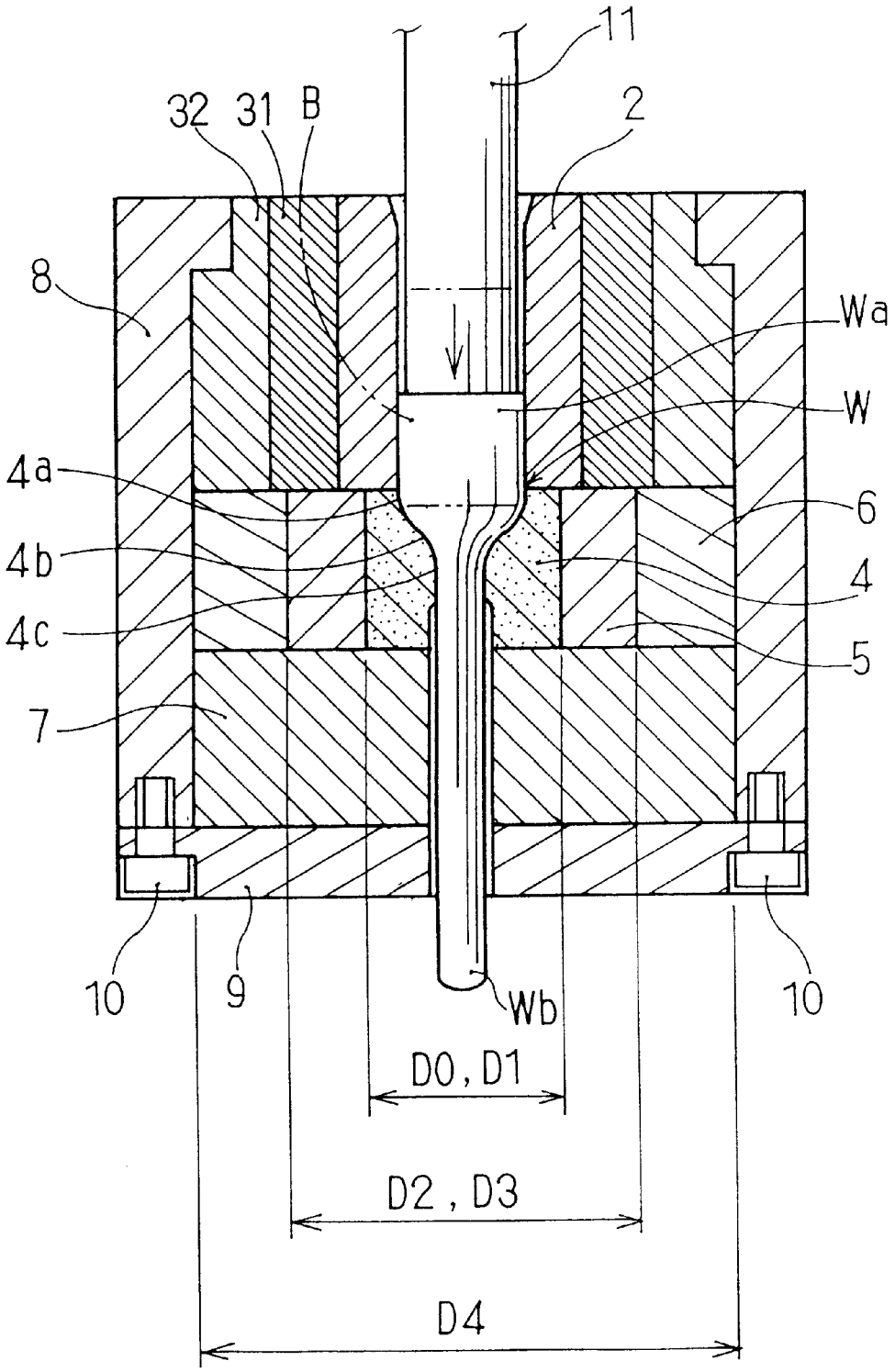
FIG. 2 is a sectional view illustrating a hot extrusion forging die for use in titanium alloy according to another embodiment of the present invention.

Further, the guiding die member 2 may be made of silicon nitride or ceramic material such as SIALON. In this case, it is preferable that, as illustrated in FIG. 2, the reinforcement ring 3 be composed of two members, i.e., an inside reinforcement ring 31 and outside reinforcement ring 32 each made of SKD 61 which is a steel material having a toughness, as in the case of the reinforcement rings 5 and 6. That is, around the die member 2, there is caused to be disposed the inside reinforcement ring 31 such that this inside reinforcement ring has an interference for shrinkage fitting. Further, around the inside reinforcement ring 31, there is caused to be disposed the outside reinforcement ring 32 such that this outside reinforcement ring has an interference for taper force-insertion or shrinkage fitting. If the reinforcement ring 3 is constructed as mentioned above, it is possible to prevent the reinforcement rings 31 and 32 from being loosened with respect to the die member 2 due to the difference between the coefficients of thermal expansion. Also, it is possible to ensure a high strength of the die member 2.

Also, the pressure receiving plate 7 is made of SKH 51 or the like. The case 8 is made of SKD 61 or the like. The cap 9 is made of SKD 61 or the like.

In the case of this embodiment, the die member 4 is configured such that its outer-peripheral surface is made straight along the axis of the die member 4. Also, the inner-peripheral surface of the inside reinforcement ring 5 is made straight in correspondence with the outer-peripheral surface of the die member 4. The reason why the inner-peripheral surface of the inside reinforcement ring 5 has been made straight is that it is arranged that the entire inner-peripheral surface of this ring 5 can have a prescribed dimension of interference with respect to the die member 4.

The outside diameter D0 of the die member 4 is set to be 30Φ. The inside reinforcement ring 5 is constructed such that its inside diameter D1 has a dimension of 0.15 mm (the dimension obtained by subtracting D1 from D0) as the interference available at normal temperature with respect to the outside diameter D0 of the die member 4. The inside reinforcement ring 5 is assembled to around the die member 4 by shrinkage fitting. The heating temperature at the time of shrinkage fitting is approximately 600° C.

Also, the outside diameter D2 of the inside reinforcement ring 5 is set to be approximately 45Φ. The outside reinforcement ring 6 is constructed such that its inside diameter D3 has a dimension of 0.225 mm (the dimension obtained by subtracting D3 from D2) as the interference available at normal temperature with respect to the outer-peripheral surface of the inside reinforcement ring 5. The outside diameter D4 of the outside reinforcement ring 6 is set to be 70Φ.

Further, the inner-peripheral surface of the inside reinforcement ring 5 and the outer-peripheral surface of the outside reinforcement ring 6 are correspondingly shaped like a downwardly or upwardly diverged taper. The reason why this configuration is made is to make it possible to force insert the outside reinforcement ring 6 onto the inside reinforcement ring 5.

In the case of this embodiment, first, the inside reinforcement ring 5 is disposed around the die member 4 by shrinkage fitting. Thereafter, by taper force-insertion, the outside reinforcement ring 6 is disposed around the inside reinforcement ring 5. By performing these operations, the die member 4 and the rings 5, 6 are assembled together. At this time, the interference of the inside reinforcement ring 5 and outside reinforcement ring 6 with respect to the die 4 at normal temperature (the dimension obtained by subtracting from the outside diameter D0 of the die member 4 the inside diameter D1 of the inside reinforcement ring 5 kept having the outside reinforcement ring 6 assembled thereto) was 0.258 mm. Also, the interference of the inside reinforcement ring 5 and outside reinforcement ring 6 with respect to the die 4 at a time of preheating performed at 550° C. (the dimension obtained by subtracting from the outside diameter D0 of the die member 4 the inside diameter D1 of the inside reinforcement ring 5 kept having the outside reinforcement ring 6 assembled thereto) was 0.135 mm.

For example, when only the inside reinforcement ring 5 had been assembled to the die member 4 by shrinkage fitting, as stated previously the interference of the inside reinforcement ring 5 with respect to the die member 4 at normal temperature (the dimension obtained by subtracting D1 from D0) was 0.15 mm. However, when only the inside reinforcement ring 5 had been assembled to the die member 4 by shrinkage fitting, the interference of the inside reinforcement ring 5 with respect to the die member 4 at a time of heating of 550° C. (the dimension obtained by subtracting D1 from D0) was decreased down to a remarkably small value of 0.027 mm.

On or around the case 8 of the forging die 1 according to this embodiment, there is disposed a pre-heater not illustrated such as a band heater or high frequency heater. The pre-heater is for the purpose of preheat the die member 4 and the reinforcement rings 5 and 6 to 550° C.

Next, the mode of use of the forging die 1 according to this embodiment will be explained.

First, a titanium alloy-made billet B which has been coated with graphite is heated to and kept at 1200° C. beforehand by, for example, high frequency heating. Then, the billet B is put from the guiding die 2 into the large-diameter hole portion 4*a* of the diameter-reducing die member 4 and is disposed in this die member 4. It is to be noted that the die member 4 and the like are also preheated at 200 to 550° C. beforehand by a pre-heater not illustrated.

Thereafter, a punch 11 is hammered into. Then, the billet B is extruded to the small-diameter hole portion 4*c* side of the die member 4, whereby there is manufactured an extruded work W having a large-diameter portion Wa and a shaft portion Wb.

Thereafter, by operating a knockout device not illustrated, the extruded work W is taken out. In this connection, in the forging die 1 according to this embodiment, the die member 4 for diameter reducing the titanium alloy-made billet B is made of silicon nitride which is a kind of ceramic material. The coefficient of linear expansion of the silicon nitride ($Si_3N_4$) is $3.0\times10^{-6}$/° C., which is smaller than the coefficient of linear expansion ($8.4\times10^{-6}$/° C.) of titanium alloy. For this reason, even when the taking-out of the extruded work W by the knockout device immediately after the performance of the extrusion working is late with the result that the temperature of the die member 4 and work W has been lowered, the die member 4 does not stick to the extruded work W. Accordingly, the taking-out of the extruded work W by the knockout device can be easily performed.

Also, when the die member 4 is made of ceramic, the die member 4 is unlikely to adhere to the work W even if preheated at 200 to 550° C. or so. Therefore, the seizure of the titanium alloy-made billet B to the die member 4 is unlikely to occur. This makes it possible to use a graphite coating as a lubricant for use in the billet B. The graphite coating is a lubricant which is not needed to be removed after working. Accordingly, in a case where manufacturing the extruded work W by performing the extrusion working of the titanium alloy-made billet B by using the forging die 1 according to this embodiment, it becomes unnecessary to perform post-working removal of the lubricant. Therefore, in the manufacturing method for manufacturing the work W, which uses the forging die 1 according to this embodiment, processing after the performance of the extrusion working can be facilitated with the result that it is possible to manufacture the extruded work W without spending time and labour very much.

In the case of this embodiment, around the diameter-reducing die member 4, there is disposed the inside reinforcement ring 5 made of alloy tool steel such that this ring 5 has an interference with respect to the die member 4. Further, around the inside reinforcement ring 5, there is disposed the outside reinforcement ring 6 made of alloy tool steel such that this ring 6 has an interference with respect to the ring 5. And, the interference between the die member 4 and the inside reinforcement ring 5 is formed as an interference for shrinkage fitting. As a result, this forging die 1 can ensure a large interference (0.135 mm) at even the time of preheating with respect to the die member 4 and without damaging this die member 4. Also, the forging die 1 can ensure a high strength of the die member 4.

The reason for this is as follows. In a case where only one reinforcement ring 5 is provided around the ceramic-made die member 4, there arises the necessity of preheating also this one reinforcement ring at 200 to 550° C. or so. However, in the case of only the reinforcement ring 5 alone made of alloy tool steel, when this ring 5 is preheated at a temperature of 550° C., the interference becomes inconveniently small (0.027 mm as referred to previously) at the preheating time. This is because the coefficient of linear expansion of ceramic is small (the coefficient of linear expansion of $Si_3N_4$ is $3.0\times10^{-6}$/° C.) and the coefficient of linear expansion of steel is large (the coefficient of linear expansion of SKD 61 is $10.5\times10^{-6}$/° C.). For this reason, in the case where only one reinforcement 5 alone is provided around the ceramic-made die member 4, a large interference becomes necessary. However, shrinkage fitting is a mode of fitting in which the ring 5 is assembled by being shrunk after having been thermally expanded. That is, the application of shrinkage fitting cannot ensure a large interference. Therefore, it results that in order that a large interference can be ensured, the reinforcement ring 5 is disposed around the die member 4 by taper force-insertion. However, ensuring a large interference by such a taper force-insertion results in that the ceramic-made die member 4 is inconveniently broken.

In contrast to this, as in the case of this embodiment, first, the inside reinforcement ring 5 is assembled around the die member 4 by shrinkage fitting. Subsequently, around the inside reinforcement ring 5 there is further assembled the outside reinforcement ring 6 made of alloy tool steel, such that this ring 6 has an interference. That is, the inside reinforcement ring 5 is not only caused to act on the die member 4 but the interference of the outside reinforcement ring 6 is also caused to act thereon through the inside reinforcement ring 5. Therefore, a large interference (0.135 mm as referred to previously) can be ensured with respect to the die member 4 at the preheating time.

Also, the inside reinforcement ring 5 is assembled to the die member 4 by shrinkage fitting. Therefore, the inside reinforcement ring 5 has a small interference, with the result that there is no likelihood of the die member 4 being broken. Conversely, the inside reinforcement ring 5 can serve as a cushion for a pressing force applied by the interference of the outside reinforcement ring 6 to the die member 4 and can buffer this pressing force. For this reason, the inside reinforcement ring 5 can contribute to preventing the die member 4 from being broken due to the interference of the outside reinforcement ring 6. As a result, even when the outside reinforcement ring 6 is assembled to the inside reinforcement ring 5 by the taper force-insertion enabling its ensurement of a large interference with respect to the inside reinforcement ring 5, the die member 4 is not broken. And, the outside reinforcement ring 6 can ensure a large interference of the inside reinforcement ring 5 with respect to the die member 4.

It is to be noted that if a large interference is ensured, the outside reinforcement ring 6 may be assembled to the inside reinforcement ring 5 by shrinkage fitting.

And, further, in a case where the inside reinforcement ring 5 is assembled to the die member 4 by shrinkage fitting, the both may be shrinkage fitted together by utilizing a taper surface. However, if as in the case of this embodiment the outer-peripheral surface of the die member 4 and the inner-peripheral surface of the inside reinforcement ring 5 are respectively correspondingly made straight and the both are assembled together by shrinkage fitting, it is possible to suppress the occurrence of variation in the interference due to the error made in taper angle or reference diameter position. As a result, a stable interference can be ensured and also the durability of the die member 4 can be enhanced.

What is claimed is:

1. A hot extrusion forging die for use in titanium alloy comprising:

a die member used for extrusion working a titanium alloy-made billet in such a manner as to restrict the outside diameter thereof, a guiding die disposed on a billet insertion side of the die member, the die member and the guiding die being made of ceramic, a first inside reinforcement ring disposed around the die member, said first reinforcement ring being made of steel having a toughness such that the first inside reinforcement ring has an interference with respect to the die member;

a first outside reinforcement ring disposed around the first inside reinforcement ring, the first outside reinforcement ring being made of steel having a toughness such that the first outside reinforcement ring has an interference with respect to the first inside reinforcement ring;

the interference between the die member and the first inside reinforcement ring being formed as an interference for shrinkage fitting;

a second inside reinforcement ring disposed around the guiding die, the second inside reinforcement ring being made of steel having a toughness such that the second inside reinforcement ring has an interference with respect to the guiding die, and a second outside reinforcement ring disposed around the second inside reinforcement ring, the outside reinforcement ring being made of steel having a toughness such that the second outside reinforcement ring has an interference with respect to the second inside reinforcement ring, the interference between the guiding die member and the inside reinforcement ring is formed as an interference for shrinkage fitting.

2. A hot extrusion forging die for use in titanium alloy as set forth in claim 1, wherein an outer-peripheral surface of the die member is straight and untapered; and an inner-peripheral surface of the first inside reinforcement ring is straight and untapered in correspondence with the outer-peripheral surface of the die member.

3. A hot extrusion forging die as set forth in claim 1 further comprising a graphite lubricant coating the billet.

4. A hot extrusion forging die as set forth in claim 1 wherein the die member and the guiding die are integrated together in a case.

5. A method for manufacturing an extruded work, which manufactures the extruded work by extrusion working a titanium alloy-made billet by the use of a hot extrusion forging die for use in titanium alloy having the following construction through the execution of the following steps in such a way as to diameter-reduce the outside diameter of the billet and then by taking out the extruded work, the hot extrusion forging die for use in titanium alloy having a construction which includes:

a ceramic-made die member into which the billet is forcedly inserted;

an inside reinforcement ring disposed around the die member by shrinkage fitting and made of steel having a toughness;

an outside reinforcement ring disposed around the inside reinforcement ring such that the outside reinforcement ring has an interference with respect thereto and made of steel having a toughness; and a punch hammered into the die member, the method comprising:

a step of coating the billet with a lubricant which is not needed to be removed after extrusion working and then heating the billet;

a step of preheating the die member, inside reinforcement ring and outside reinforcement ring;

a working step performed by inserting the billet into the die member and hammering the punch thereinto; and a taking-out step for taking out the extruded work.

6. A method for manufacturing an extruded work as set forth in claim 7, wherein a graphite coating is used as the lubricant.

7. A hot extrusion forging die for use in titanium alloy comprising:

a die member used for extrusion working a titanium alloy-made billet in such a manner as to restrict the outside diameter thereof, a guiding die disposed on a billet insertion side of the die member, and the die member being made of ceramic, wherein the guiding die is made of ceramic.

8. A hot extrusion forging die as set forth in claim 7, further comprising a graphite lubricant coating the billet.

9. A hot extrusion forging die as set forth in claim 7, wherein the die member and the guiding die are integrated together in a case.

* * * * *

UNITED STATES PATENT AND TRADEMARK OFFICE

CERTIFICATE OF CORRECTION

PATENT NO. : 5,964,120
DATED : October 12, 1999
INVENTOR(S) : Iwase, et. al.

It is certified that error appears in the above-identified patent and that said Letters Patent is hereby corrected as shown below:

Column 10, Line 17, please delete the word " Claim 7", and insert therefor, -- Claim 5 --

Signed and Sealed this

Twenty-fourth Day of October, 2000

*Attest:*

*Attesting Officer*

Q. TODD DICKINSON

*Director of Patents and Trademarks*